US006876352B1

(12) United States Patent
Sato et al.

(10) Patent No.: US 6,876,352 B1
(45) Date of Patent: Apr. 5, 2005

(54) SCANNING CIRCUIT

(75) Inventors: Tetsushi Sato, Tokyo (JP); Hiroyuki Sekine, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/577,843

(22) Filed: May 25, 2000

(30) Foreign Application Priority Data

May 28, 1999 (JP) ..... 11-149078

(51) Int. Cl.[7] ..... G09G 3/36
(52) U.S. Cl. ..... 345/100; 345/99; 345/211
(58) Field of Search ..... 327/156, 281, 327/276, 146, 153, 155; 345/98, 99, 100, 87, 94, 208, 209, 211, 213, 212

(56) References Cited

U.S. PATENT DOCUMENTS 4,195,293 A * 3/1980 Margolin ..... 345/600
5,287,025 A * 2/1994 Nishimichi ..... 327/156
6,232,939 B1 * 5/2001 Saito et al. ..... 345/93

FOREIGN PATENT DOCUMENTS

| | | | |
|---|---|---|---|
| JP | 60-113398 A | | 6/1985 |
| JP | 05-35213 A | | 2/1993 |
| JP | 05-035213 | * | 2/1993 |
| JP | 07-134277 A | | 5/1995 |
| JP | 07-134277 | * | 5/1995 |
| JP | 10-74062 A | | 3/1998 |
| JP | 10-074062 | * | 3/1998 |
| JP | 10-334685 | * | 12/1998 |
| JP | 10-334685 A | | 12/1998 |

* cited by examiner

*Primary Examiner*—Kent Chang
(74) *Attorney, Agent, or Firm*—Sughrue Mion, PLLC

(57) ABSTRACT

A scanning circuit having such a high operation margin for the phase deviation of clock signal that its operation is stable. The scanning circuit includes a bidirectional shift register having transfer gates of a transfer unit and a feedback circuit, the operation of which is control led by four phase clocks. The scanning circuit comprises a delay circuit (101) that delays control clocks (A, B) supplied to the transfer gates of the transfer unit (103) relative to control clocks (C, D) supplied to the feedback circuit (104).

16 Claims, 10 Drawing Sheets

SCANNING CIRCUIT

FIELD OF THE INVENTION

The present invention relates to a scanning circuit and in particular to a scanning circuit which is capable of bidirectionally scanning.

BACKGROUND OF THE INVENTION

For the purpose of reducing the size and cost of liquid crystal display devices, development in technology has been made to integrate on a substrate, which is a liquid crystal display substrate, peripheral drive circuits such as data and gate driver circuits for driving data and gate lines of pixel matrices, respectively. A scanning circuit for generating gate scanning and sampling pulse signals is an essential circuit component among various circuits which constitute peripheral drive circuits.

The scanning circuit should be capable of bidirectionally scanning to meet the requirements for advanced functions such as display-reversing function of the liquid crystal display. In particular, in case where the liquid crystal display is used for a liquid crystal projector system, a function of reversing an image in vertical and/or horizontal directions depending upon the manner that an optical system and a projector are used in the projector system. Thus, the bidirectional scanning circuit is an essential circuit.

Such a type of bidirectional scanning circuit includes a circuit configuration as shown in FIG. 7, which is disclosed in, for example, Japanese Patent Kokai Publication JP-A-7-134277. Referring now to FIG. 7, the bidirectional scanning circuit comprises transfer gates 103-1 through 103-(N+1) of a transfer unit, which are in series connected with each other for transferring a signal from a previous stage to a next stage depending upon a rightward or leftward shift start pulse signal input from a first or second input terminal, respectively, in response to clocks A and B; feedback circuits 104-1 through 104N for preventing the magnitude (amplitude) of the transferred pulse signals from being attenuated; and output buffer circuits 105-1 through 105-N for outputting the outputs from the feedback circuits 104-1 through 104-N as OUT 1 through OUT N. The feedback circuits 104-1 through 104-N comprise inverters 106-1 through 106-N having input and output terminals which are connected to each other and clocked inverters 110-1 through 110-N as shown in FIG. 7. The clocked inverters 110-1 through 110-N are turned on or off in response to clock signals C and D.

The clocks A and B are alternatingly input to alternative gates of the n and p channel MOS transistors which form the transfer gates 103-1 through 103-(N+1) of the transfer unit. The clocks A and B are alternatingly input to the alternative clocked inverters 110-1 through 110-N of the feedback circuits 104-1 through 104-N.

FIG. 10 shows a circuit configuration of the clocked inverters 110-1 through 110-N. The symbol and circuit configuration of the clocked inverter circuit (transistors T3, T4) which supplies clock signals C and D to the gates of n and p channel transistors T2 and T1, respectively, is illustrated in FIG. 10(*a*). A symbol- and circuit-configuration of the clocked inverter circuit (transistors T3, T4) which supplies clock signals D and C to n and p channel MOS transistors T2 and T1, respectively, is illustrated in FIG. 10(*b*). The p and n channel MOS transistors T3 and T4 constitute a CMOS converter. Transistor T3, T4 are connected between a drain of the p channel MOS transistor T1 and a drain of the n channel MOS transistor T2, and have their gates which are commonly connected to each other and connected to an input terminal, with their drains being commonly connected to each other and connected to an output terminal. The CMOS inverter is turned on or off by turning on or off a current path between the power sources VDD and VSS depending upon the value of complimentary clocks C and D.

FIG. 8 is a timing chart explaining the operation of the prior art scanning circuit shown in FIG. 7. In the timing chart, wave forms of clocsk A to D and a signal on the terminal STR, signals OUT 1 to OUT N in case of rightward shift are illustrated.

In case of a rightward shift, a start pulse STR is input to a first input terminal STR in a timing relationship as shown in FIG. 8 and the second input terminal STL is opened. The clock signals A and D are a common clock $\phi$ and clock signals B and C are a common clock signal $\overline{\phi}$(an inverted signal of the clock $\phi$). The clocks A and B are complimentary two-phase signals and C and D are also complimentary two-phase signals.

A rightward shift scanning circuit is established by presetting clock signals A to D in such a manner, so that scanning pulse signals which are shifted in the order of from the scanning output OUT 1 to OUT N are output.

FIG. 9 is a timing chart in case of a leftward shift. In case of the leftward shift, a start pulse STL is input to a second input terminal STL in a timing relationship as shown in FIG. 9 and the first input terminal STR is opened. The clock signals A and C are a common clock $\phi$ and clock signals B and D are a common clock signal $\overline{\phi}$(an inverted signal of the clock 4). The clock C and D are exchanged each other as compared to the case with the rightward shift.

A leftward shift scanning circuit is formed by presetting clock signals A to D in such a manner, so that scanning pulse signals which are shifted in the order of the scanning output OUT N to OUT 1 are output.

Use of the scanning circuit which is shown in FIG. 7 enables the shift direction to be switched without any additional circuit for switching the shift direction.

SUMMARY OF THE DISCLOSURE

However, various problems have been encountered in the course of the investigations toward the present invention. First the conventional bidirectional scanning circuit which is shown in FIG. 7 has a problem that malfunction is liable to occur when phase deviation occurs between the clock signals A to D used for control, so that the operational margin for the phase deviation between the control clocks is very low.

When a phase deviation occurs between four clocks A to D which control the bidirectional shift register circuit, for example, such a phase deviation such that the clock signals C and D are delayed relative to the clock signals A and B occurs, the operation (turning on) timing of the feedback circuit is delayed relative to the operational (turning on) timing of the transfer gates for transferring pulses, so that the magnitude (amplitude) of the pulse signal which is transferred through the transfer unit is attenuated in an amount corresponding to the delay. When the voltage magnitude (amplitude) of the transferred pulse signal is attenuated below a threshold value of the feedback circuit, it would become impossible to conduct pulse transferring.

Therefore, the operation margin for such a phase deviation is very low. As a result, malfunction is liable to occur and it is difficult to make the timing design easier.

Accordingly, the present invention has been achieved based upon the recognition of the above-mentioned problem. It is an object of the present invention to provide a scanning circuit having a high its operation margin for the phase deviation between the clock signals so that its operation is stable.

Further objects of the present invention will become apparent in the entire disclosure.

According to the present invention typically, a scanning circuit of the present invention increases the operation margin relative to the phase deviation among the clock signals by delaying the clock signals A, B as compared to the clock signals C, D. Specifically, according to an aspect of the present invention there is provided a scanning circuit comprising a transfer unit made up of a plurality stages of the transfer gates which are in series connected to each other, and a plurality of feedback circuits which are connected to the connecting points (modes) between the transfer gates, respectively, wherein the scanning circuit comprises a delay circuit delaying the clocks which control the operation timing of the transfer gates of the transfer unit relative to the clocks which control the operation timing of the feedback circuits.

According to a first aspect, there is provided a scanning circuit comprising:

a bidirectional shift register having transfer gates of a transfer unit and a feedback circuit, the operation of which is controlled by four phase clocks, wherein the scanning circuit comprises a delay circuit that delays control clocks supplied to the transfer gates of the transfer unit relative to control clocks supplied to the feedback circuit.

According to a second aspect, there is provided a scanning circuit comprising:

a transfer unit comprising a plurality stages of transfer gates which are in series connected to each other;

a plurality of feedback circuits which are connected to connecting points between the transfer gates, the feedback circuits eliminating amplitude attenuation of signals transferred through the transfer unit, wherein the scanning circuit comprises a delay circuit that delays control clocks controlling operation timing of the transfer gates of the transfer unit relative to control clocks controlling operation timing of the feedback circuit.

According to a third aspect, there is provided a scanning circuit comprising:

a transfer unit comprising a plural ity stages of transfer gates which are in series connected with each other, and a plurality of feedback circuits which are connected to connecting points between the transfer gates.

the feedback circuits eliminating amplitude attenuation of signals transferred via the transfer unit, (a) wherein the scanning circuit comprises:

a phase control circuit having an input terminal receiving two-phase clocks and outputting a signal obtained by non-inverting/inverting the received two-phase clocks based upon a value of a control signal, (b) wherein the two-phase clocks from the delay circuit are delayed relative to the two-phase clocks output from the phase control circuit, and (c) wherein the two-phase clocks which have been delayed by the delay circuit are supplied to the transfer gates of the transfer unit, and the two-phase clocks from the phase control circuit are supplied to the feedback circuits.

In the scanning circuit, each of the feedback circuits may comprises:

a first inverter having an input terminal connected to a connection point between transfer gates which form the transfer unit, and a second inverter having an input terminal connected to an output terminal of the first inverter and an output terminal connected to the input terminal of the first inverter via a transfer gate which is turned on or off in response to the clocks supplied to the feedback circuit.

Further each of the feedback circuits may comprise:

a first inverter having an input terminal connected to a connection point between transfer gates which form the transfer unit, and a clocked inverter having an input terminal connected to an output terminal of the first inverter and an output terminal connected to the input terminal of the first inverter, the clocked inverter being turned on or off in response to the clocks supplied to the feedback circuits.

According to a fourth aspect, there is provided a scanning circuit which comprises:

(a) a transfer unit having a plurality of stages of transfer gates which are in series connected to each other, the transfer gates delaying and transferring input pulse signals;

(b) a plurality of feedback circuits including two stage inverters, each of the feedback circuits being connected to a connecting point between the transfer gates and have input and output terminals which are connected to each other via a switch; and (c) a delay circuit that delays a phase of a clock controlling timing relationship of turning on or off of the transfer gates of the transfer unit relative to the phase of the clock controlling timing relationship of turning on or off the feedback circuits.

According to a fifth aspect, there is provided a scanning circuit comprising:

(a) a transfer unit having a plurality stages of transfer gates which are in series connected to each other to delay and transfer input pulse signals;

(b) a plurality of feedback circuits each including an inverter and a clocked inverter, each of the feedback circuits being connected to a connecting point between the transfer gates and having input and output terminals which are connected to each other for feedback; and (c) a delay circuit that delays a phase of a clock for controlling timing relationship of turning on or off of the transfer gates of the transfer unit relative to a phase of a clock for controlling timing relationship of turning on or off of the clocked inverter of the feedback circuit.

According to a sixth aspect, the scanning circuit further comprises a phase control circuit having an input terminal to which two-phase clocks are input to output signals obtained by non-inverting/inverting the input two-phase clocks based upon a value of a control signal for controlling a shift direction, and wherein the delay circuit delays the input two-phase clocks relative to the signals of two-phase clocks relative to the signals of two-phase clocks output from the phase control circuit.

In the present invention, the transfer unit (or bidirectional shift register) may have only one input terminal, which is connected to one end and the other end of the transfer unit.

PREFERRED EMBODIMENTS OF THE INVENTION

In a preferred embodiment, the scanning circuit of the present invention comprises a bidirectional shift register circuit which is controlled by four clock signals and a delay circuit which is added to its control lines along which the control clock signals are provided, in which the operation margin for the phase deviation which may occur between control clocks supplied from an external circuit is high.

The bidirectional shift register circuit is controlled by total of four clock signals including clocks A and B which control the transfer gates which transfer the pulse signals from a previous stage and clocks C and D which control a feedback circuit to prevent the magnitude (amplitude) of the transferred pulse signals from being attenuated. The shift direction can be selected by reversing (i.e., reversing and again reversing returning) the phase between the clocks C and D.

Figure 7:
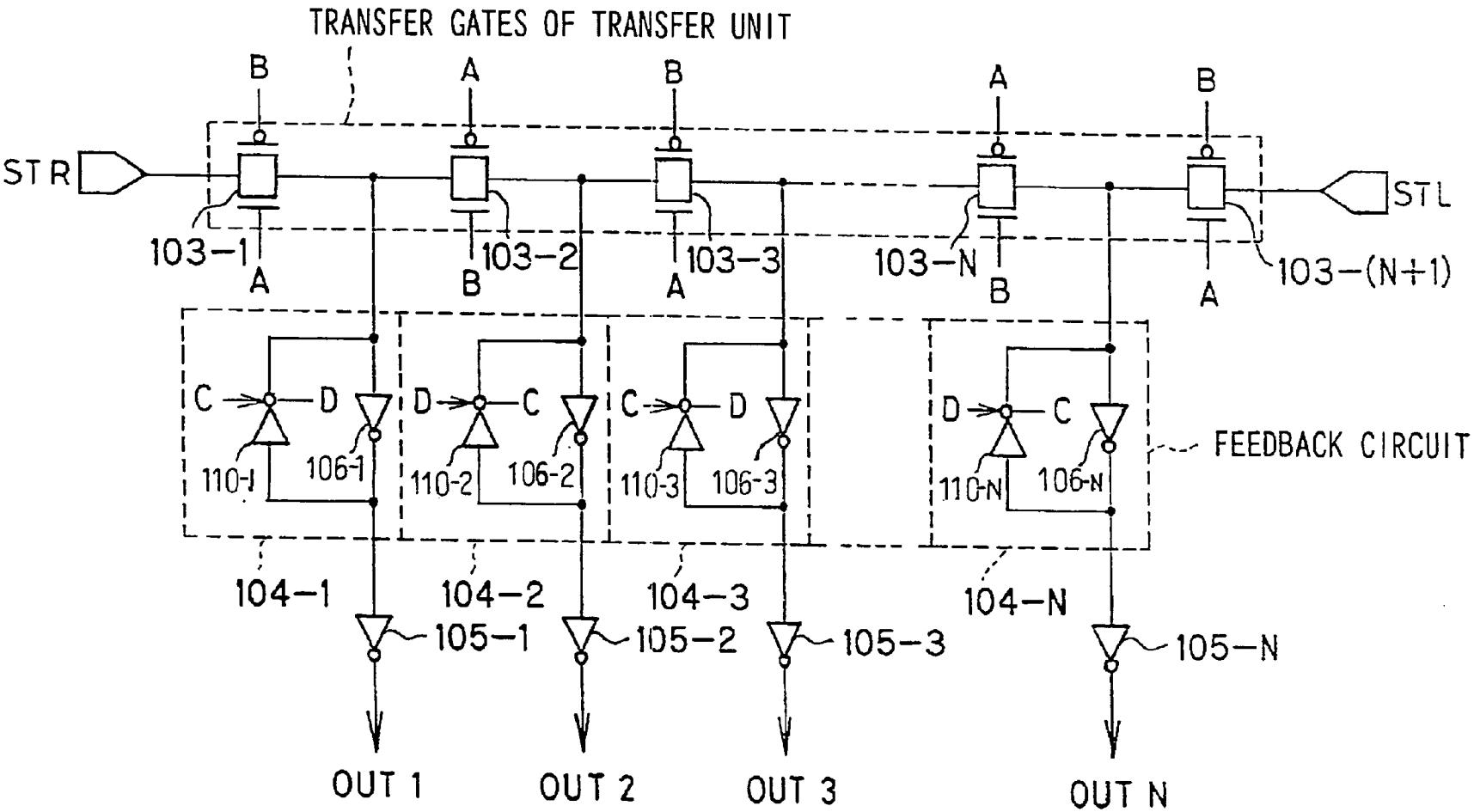
FIG. 7 PRIOR ART
FIG. 7 A diagram showing the configuration of a prior art scanning circuit.
Figure 8:
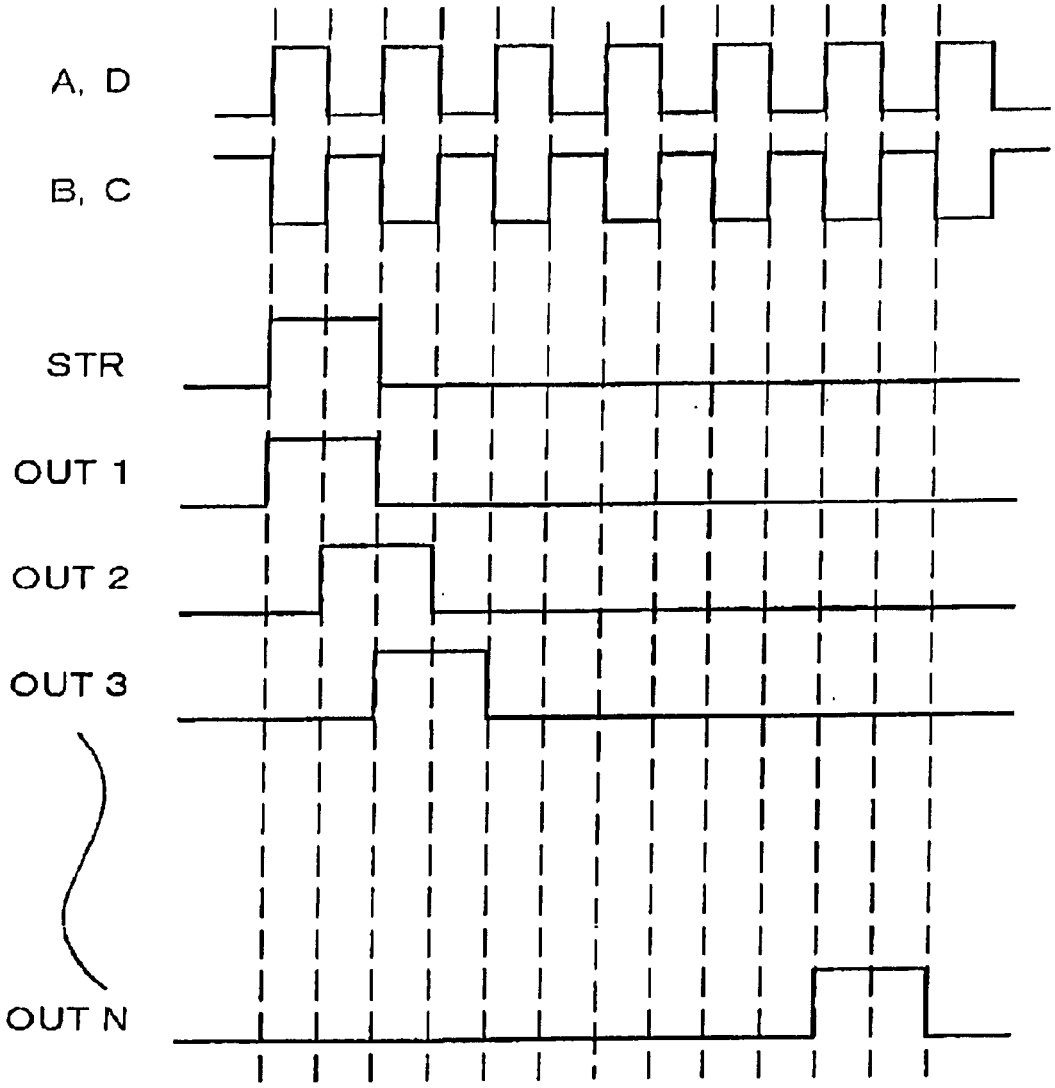
FIG . 8 PRIOR ART
FIG. 8 A timing chart showing a rightward shift operation of the prior art scanning circuit.
Figure 9:
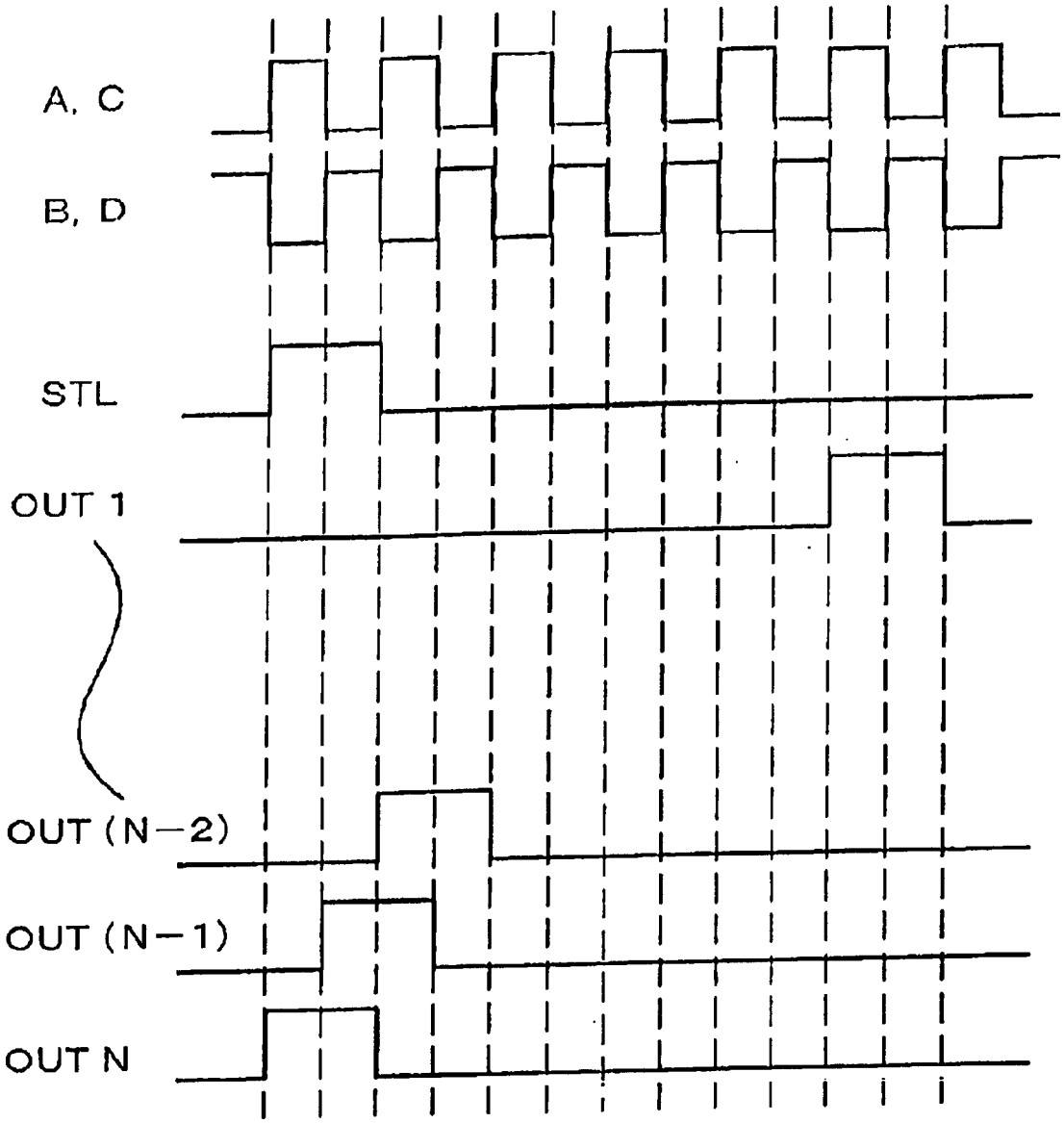
FIG . 9 PRIOR ART
FIG. 9 A timing chart showing a leftward shift operation of the prior art scanning circuit.

In the prior art scanning circuit as shown in FIG. 7, the operation timing of the feedback circuit is ahead of (earlier than) that of the transfer gates which transfer the start pulse in case ("first case") where the clock signals A and B are delayed relative to the clock signals C and D. (This is in contrasted to a phase deviation case ("second case") where the clock signals C and D are delayed relative to the clock signals A and B.) In the first case, no attenuation of the magnitude of the transferred pulse occurs. In other words, the operation margin for such a phase deviation is high.

The present inventors made the present invention based upon the above-mentioned finding. In accordance with the present invention, the operation margin is assured by providing the control clock wiring with a delay circuit to always delay the clocks A and B relative to the clocks C and D. That is, the operation margin is secured if a phase deviation should occur among the control clocks, i.e., even when the clocks C and D should be delayed relative to the clocks A, B. In such a manner, the operation margin for the phase deviation among the control clocks is made larger than the case with the prior art.

In a preferred embodiment, the scanning circuit of the present invention comprises a plurality stages of transfer gates of a transfer unit, which are in series connected to each other; a plurality of feedback circuits each connected to a connecting point (node) between the transfer gates, and further comprises a delay circuit (101) which delays control clocks (A, B) which are supplied to the transfer gates (103) of the transfer unit relative to the control clocks (C, D) which are supplied to a feedback circuit (104).

In a preferred embodiment, a scanning circuit of the present invention comprises a plurality stages of transfer gates of a transfer unit, which are in series connected with each other and a plurality of feedback circuits which are each connected to each of connecting points between the transfer gates, and further comprises a phase control circuit (109) having an input terminal to which two-phase clocks are input for outputting a signal non-inverting/inverting two-phase clocks based upon a value of a control signal. The two-phase clocks from said delay circuit (101) are delayed relative to the two-phase clocks output from the phase control circuit (109), and the two-phase clocks which have been delayed by said delay circuit (101) are supplied to the transfer gates (103) of the transfer unit. The two-phase clocks from the phase control circuit are supplied to the feedback circuits (104) of the bidirectional shift register.

In one embodiment of the present invention, the feedback circuit (104) comprises a first inverter (106) having an input terminal which is connected to a connection point (node) between transfer gates which form the transfer gates (104) of the transfer unit and a second inverter (107) having an input terminal which is connected to an output terminal of the first inverter and an output terminal which is connected to the input terminal of the first inverter via a transfer gate (108) which is turned on or off in response to a clock supplied to the feedback circuit.

In one embodiment of the present invention, the feedback circuit (104) comprises a first inverter (106) having an input terminal which is connected to a connection point between transfer gates which form the transfer gates (104) of the transfer unit and a clocked inverter (110) having an input terminal which is connected to an output terminal of the first inverter and an output terminal which is connected to the input terminal of the first inverter (106), the clocked inverter (110) being turned on or off in response to a clock supplied to the feedback circuit (refer to the feedback circuit of FIG. 7).

EMBODIMENTS

Figure 1:
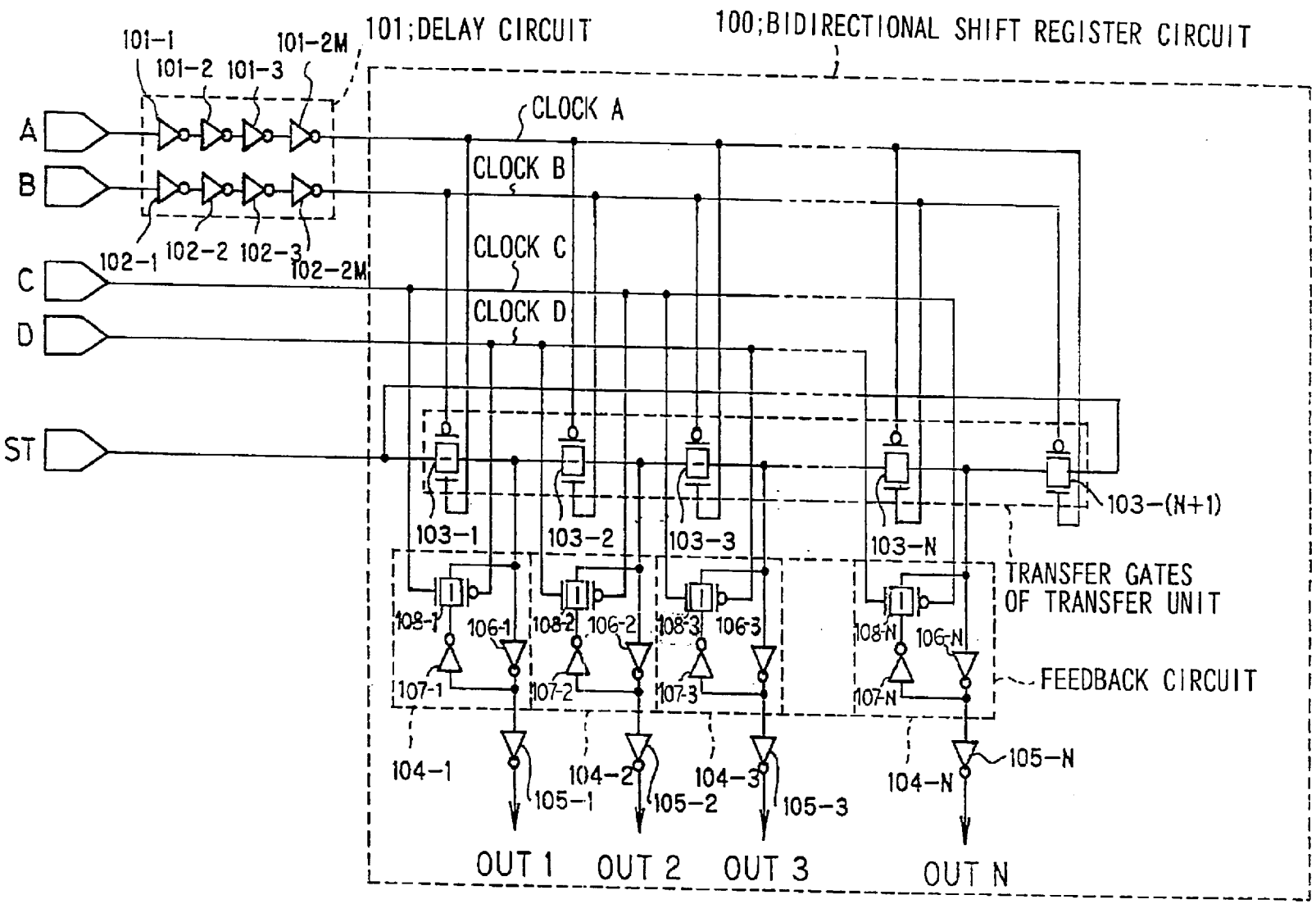
FIG. 1 A diagram showing the configuration of a first embodiment of the present invention.

Embodiments of the present invention will now be described with reference to the drawings. FIG. 1 is a diagram showing the configuration of a first embodiment of the scanning circuit of the present invention. Referring now to FIG. 1, the scanning circuit comprises a bidirectional shift register circuit 100 which is control led by four phase clocks such as clocks A through D and a delay circuit 101 which delays the clocks A and B relative to the clocks C and D.

The bidirectional shift register circuit comprises N stages of transfer gates (CMOS transfer gate) 103-1 through 103-(N+1) of a transfer unit, which gates are in series connected for successively transferring a start pulse input to an input terminal ST to a next stage in response to clocks A and B which are stage by stage alternatingly input to the gates of n and p channel MOS transistors, feedback circuits 104-1 through 104-N which prevent the attenuation of the magnitude of the transferred pulse signals and output buffer circuits 105-1 through 105-N for outputting outputs of the feedback circuits to output terminals OUT 1 through OUT N.

The feedback circuits 104-1 through 104-N comprise inverters 106-1 through 106-N having their input terminals which are connected to the connecting points of the transfer gates 103-1 through 103-N of the transfer unit; inverters 107-1 through 107-N having their input terminals which are connected to respective output terminals of the inverters 106-1 through 106-N; and transfer gates 108-1 through 108-N which are inserted between respective output terminals of the inverters 107-1 through 107-N and respective connecting points (nodes) of the transfer gates 103-1 through 103-N, of the transfer unit, alternatingly receiving the clocks C and D to the gates of the n and p channel MOS transistors. The inverters 107-1 through 107-N are connected to the input terminals of the inverters 106-1 through 106-N via the transfer gates 108-1 through 108-N, respectively, to form feedback circuits.

Even and odd number-th gates of the p and n channel MOS transistors of the transfer gates 103-1 through 103-(N+1) of the transfer unit are alternatingly connected to the clocks A and B in such a manner that adjacent transfer gates are alternatingly turned ON/OFF in a repeating manner in response to complementary two-phase signal clocks A and B.

Even and odd number-th gates of the p and n channel MOS transistors of the transfer gates 108-1 through 108-N of the transfer unit are alternatingly connected to the clocks C and D in such a manner that adjacent transfer gates are alternatingly turned ON/OFF in a repeating manner in response to complementary two-phase signal clocks C and D.

Figure 10:
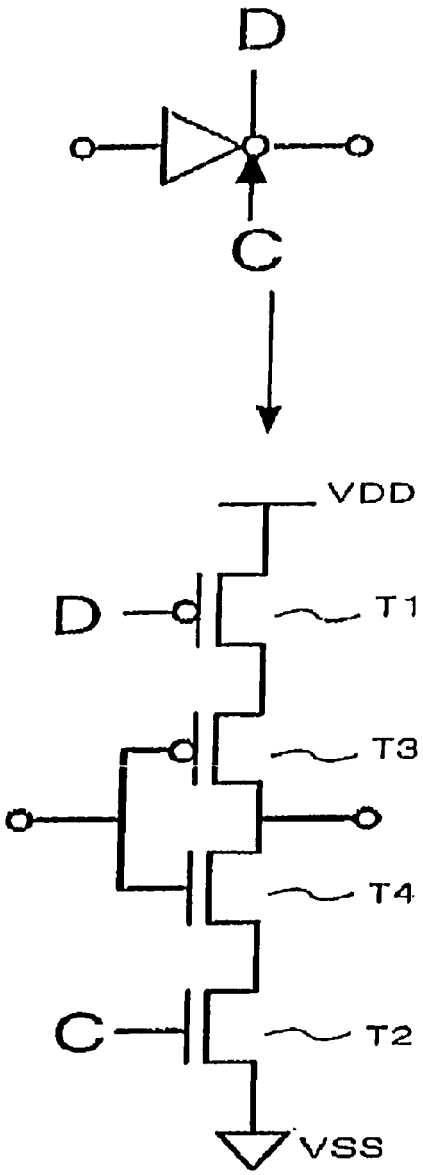
FIGS. 10(*a*) and 10(*b*) Diagrams showing the configuration of a clocked inverter.
Figure 10:
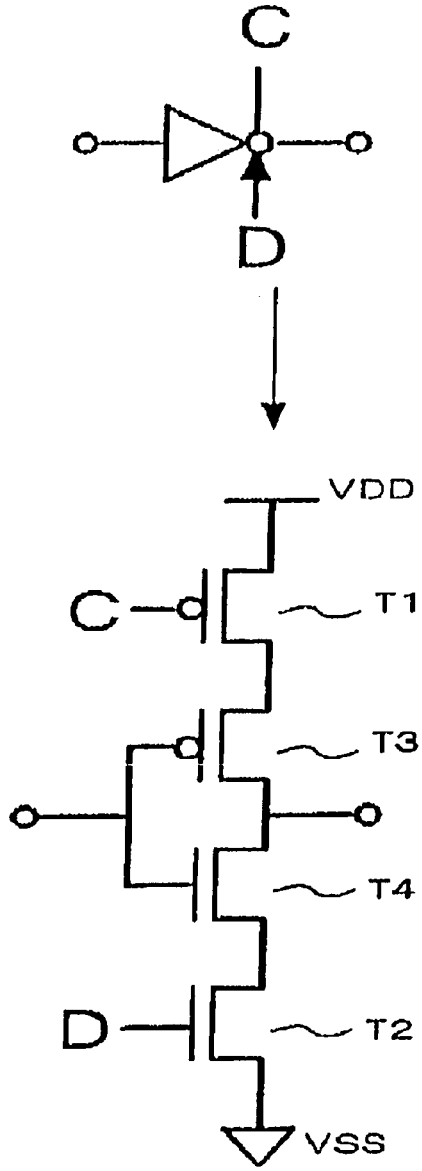

The feedback circuit may comprise the inverters 107-1 through 107-N and the transfer gates 108-1 through 108-N which are symbolically shown as clocked inverters in FIG. 10.

The delay circuit 101 is formed by in series connecting the inverters 101-1 through 101-2M with 102-1 through 102-2M at even number-th stage between the clock input terminals A and B and the control clock lines of the transfer gates of the transfer unit in order to delay the turning ON/OFF timing of the transfer gates 103-1 through 103-(N+1) of the transfer unit of the bidirectional shift register 100 relative to the turning ON/OFF timing of the feedback circuits 104-1 through 104-N.

The delay circuit 101 is not limited to the configuration including in series connected inverter, but may be any configuration including NAND gates and the like as well as any configuration including other logical elements.

The scanning circuit of one embodiment of the present invention is capable of bidirectional ly scanning by presetting the control clocks. In the following description, transferring of the start pulse from OUT 1 to OUT N in an ascending order will be defined as rightward shift and transferring of the start pulse from OUT N to OUT 1 in an descending order will be defined as leftward shift.

Figure 2:
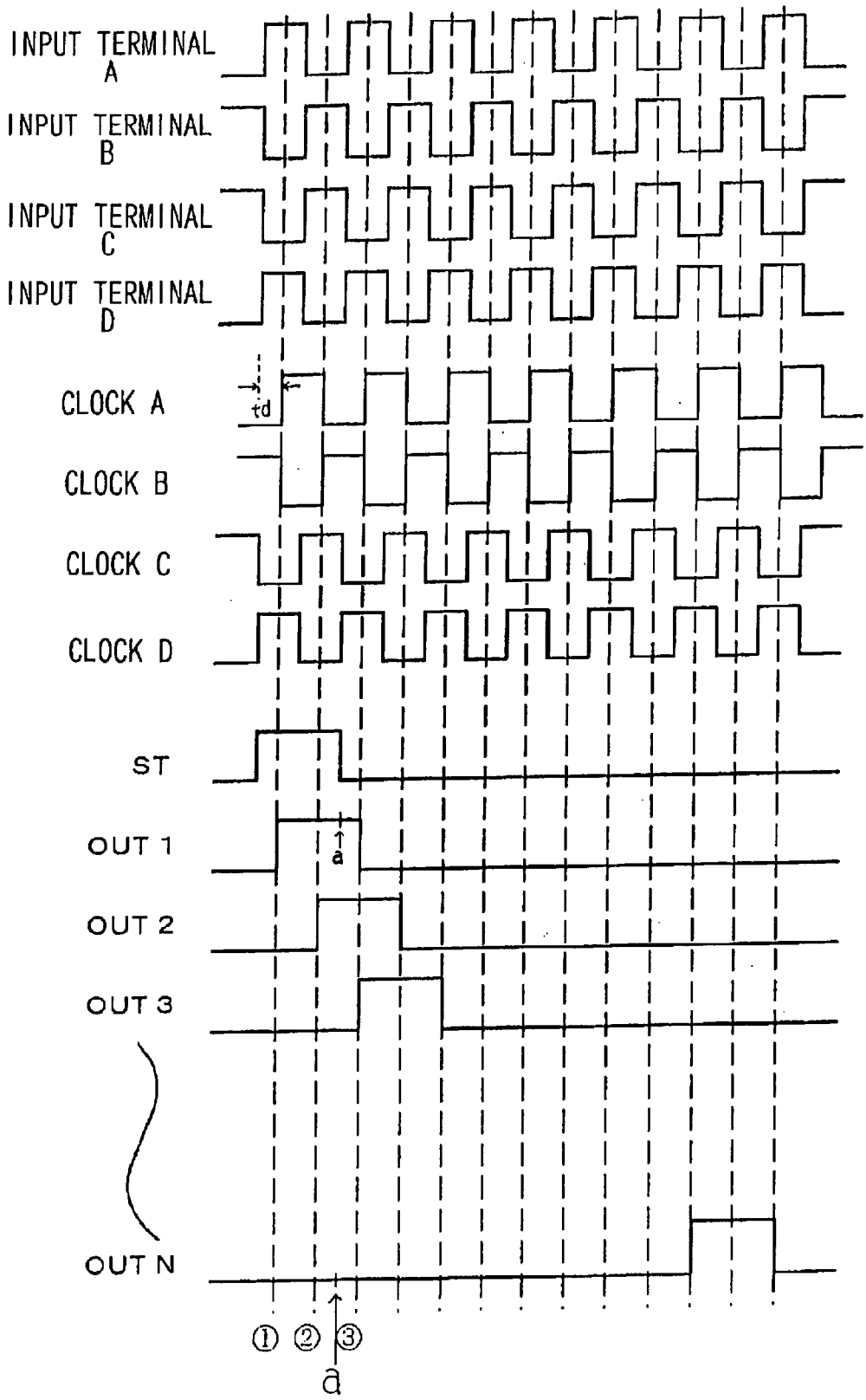
FIG. 2 A timing chart showing rightward shift operation in the first embodiment of the present invention.
Figure 3:
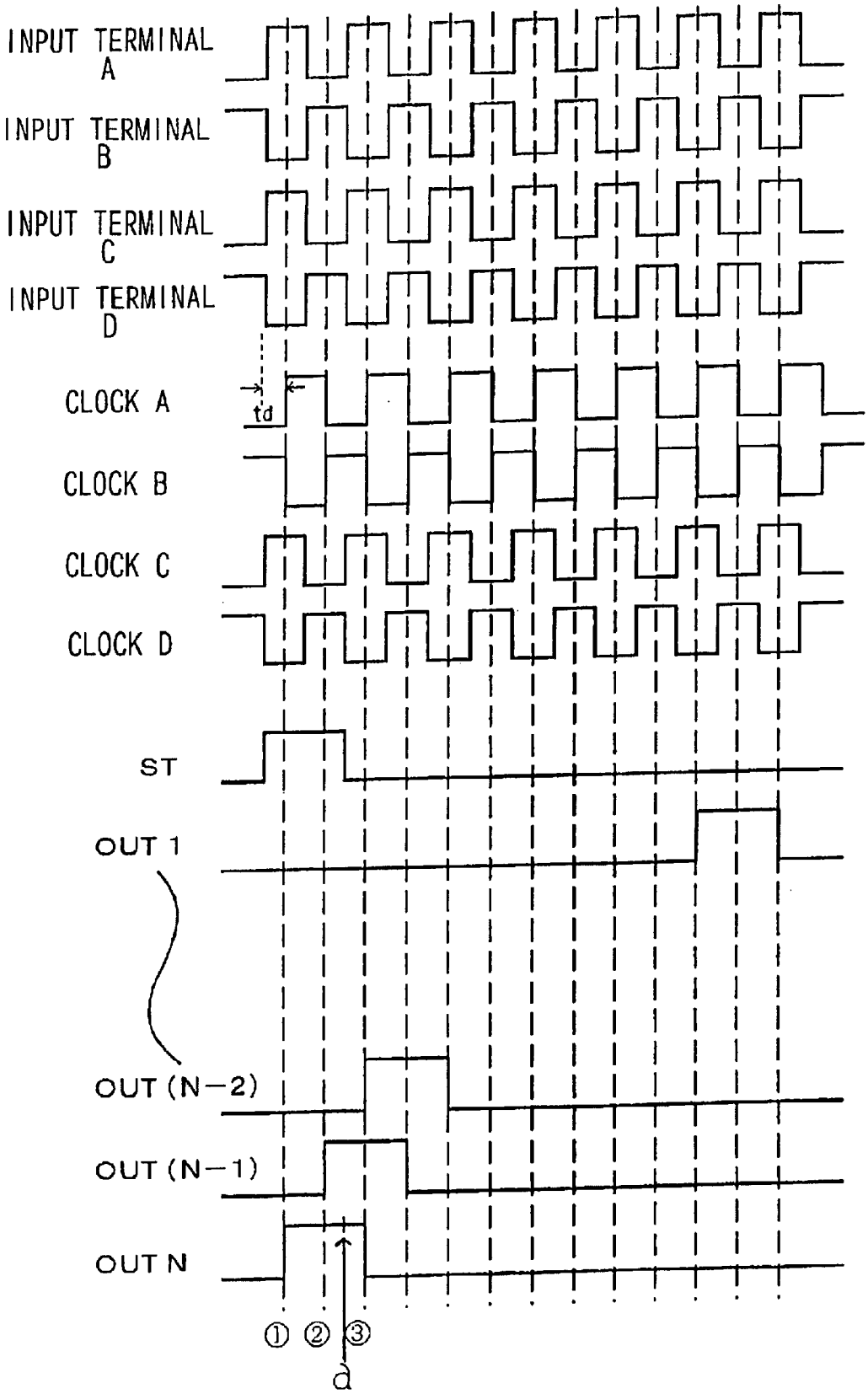
FIG. 3 A timing chart showing leftward shift operation in the first embodiment of the present invention.

FIGS. 2 and 3 are timing charts explaining the timing relationships of rightward and leftward shifts of the scanning circuit in one embodiment of the present invention, respectively. The waveforms of the signals at terminals in FIG. 1 and the clocks A through D are shown in FIGS. 2 and 3.

When the scanning circuit is to be operated in a rightward shift mode, the same phase clock signals are applied to the input terminals A and D as shown in FIG. 2. The inverse phase clock signals are applied to the input terminals B and C. The clock signals which have been provided to the input terminals A and B are delayed by the delay circuit 101 and are used as control clocks A and B for the transfer gates 103 of the transfer unit of the bidirectional shift register. The clock signals which have been given to the input terminals C and D are used as control clocks C and D of the feedback circuit 104 without being delayed.

When a start pulse signal as shown in FIG. 2 is input to the input terminal ST, the transfer gate 103-1 of the transfer unit is brought into ON from OFF in response to clocks A and B at time point (1). Since the clocks C and D are at Low and High level, respectively, the transfer gate 108-1 of the feedback circuit 104-1 is turned OFF. At and after the time point (1), the start pulse signal is output to the output terminal OUT 1 via an inverter 106-1 of the feedback circuit 104-1 and an output buffer circuit 105-1.

Then, at time point (2), the transfer gate 103-2 of the transfer unit is turned ON from OFF and delayed-transferring of the pulse signal at the output OUT 1 is conducted.

The clocks A and B are delayed relative to the clocks C and D by being time-delayed with the delay circuit 101. Accordingly, the transfer gate 108-1 of the feedback circuit 104-1 has been in a turned ON condition (i.e. inverted feedback is effected) at time point (2) since the clocks C and D are at the high and low levels, respectively. Even if the transfer gate 103-1 is brought into turned ON from turned OFF at time point (2), the pulse signal is output to the output terminal OUT 1 without attenuating its magnitude. At time point (2), the pulse signal is simultaneously transferred to the output OUT 2 via the transfer gate 103-2, inverter 106-2 and the output buffer circuit 105-2 [up to time point (a)].

Then, the pulse signal is transferred to the output OUT 3 from the output OUT 2 at time point (3) as explained below.

The transfer gate 108-2 of the feedback circuit 104-2 is turned ON at time point (a) earlier than the time point (3) by a delay time (td), upon changing over of clock C, D to L, H level, respectively. Simultaneously with this, the transfer gate 108-1 of the feedback circuit 104-1 is turned OFF. At this time, since the transfer gate 103-1 remains turned OFF, the transfer gates 103-2 and 108-2 remain turned ON, the state of the output OUT 1 will not change [from time point (a) to (3)].

Thereafter, when the transfer gates 103-1 and 103-2 are turned ON and OFF, respectively at time point (3), the output OUT 1 assumes a low level which is equal to the level of the input terminal ST again.

The above-mentioned operation is repeated so that scanning pulse signals which are in synchronization with the clocks A and B are output in the order of the outputs OUT 1 to OUT N.

When the scanning circuit is to be operated in a leftward shift mode, the same phase clock signals are applied to the input terminals A and C as shown in FIG. 3. Inverse phase clock signals are applied to the input terminals B and D. The clock signals which have been provided to the input terminals A and B are delayed by the delay circuit 101 and are used as control clocks A and B for the transfer gates 103 of the transfer unit of the bidirectional shift register. The lock signals which have been given to the input terminals C and D are used as control clocks C and D of the feedback circuit 104 without being delayed.

When the start pulse signal as shown in FIG. 3 is input to the input terminal ST, the transfer gate 103-(N+1) of the transfer unit is brought into ON from OFF in response to clocks A and B at time point (1). Since the transfer gate 108-N of the feedback circuit 104-N is turned OFF, at and after the time point (1), the start pulse signals is out put to the output terminal OUT N via an inverter 106-N of the feedback circuit 104-N and an output buffer circuit 105-N.

Then, at time point (2), the transfer gate 103-N of the transfer unit is turned ON from OFF and delayed-transferring of the pulse signal at the output OUT N is conducted. The clocks A and B are delayed relative to the clocks C and D by being time-delayed with the delay circuit 101. Accordingly, the transfer gate 108-N of the feedback circuit 104-N has been in turned ON condition at time point (2) in response to the clocks C and D. Even if the transfer gate 103-(N+1) is brought into OFF from ON at time point (2), the pulse signal is output to the output terminal OUT N without attenuating its magnitude. At time point -(2), the pulse signal is transferred to the output OUT (N−1).

Then, the pulse signal is transferred to the output terminal OUT (N−2) from the output terminal OUT (N−1) at time point (3).

The transfer gate 108-(N−1) of the feedback circuit 104-(N−1) is turned ON at time point (a) earlier than the time point (3) by a delay time (td). Simultaneously with this, the transfer gate 108-N of the feedback circuit 104-N is turned OFF. Since the transfer gate 103-(N+1) remains OFF, the transfer gates 103-N and 108-(N−1) remain ON, the state of the output OUT N will not change (i.e., no attenuation occurs).

Thereafter, when the transfer gates 103-(N+1) and 103-N are turned ON and OFF, respectively at time point (3), the output OUT N assumes a low level which is equal to the level of the input terminal ST again.

The above-mentioned operation is repeated so that scanning pulse signals are output which are in synchronization with the clocks A and B are output in the order of the outputs OUT N to OUT 1.

In the scanning circuit of the first embodiment of the present invention, the operation margin, in case where the deviation of phase occurs between clocks, can be increased by providing a delay circuit on the control clock wiring.

In accordance with the first embodiment of the present invention, operation can be assured within a range of a designed delay time by providing a delay circuit within the scanning circuit even if the above-mentioned phase deviation occurs between the control clocks which are input from an external circuit.

Figure 4:
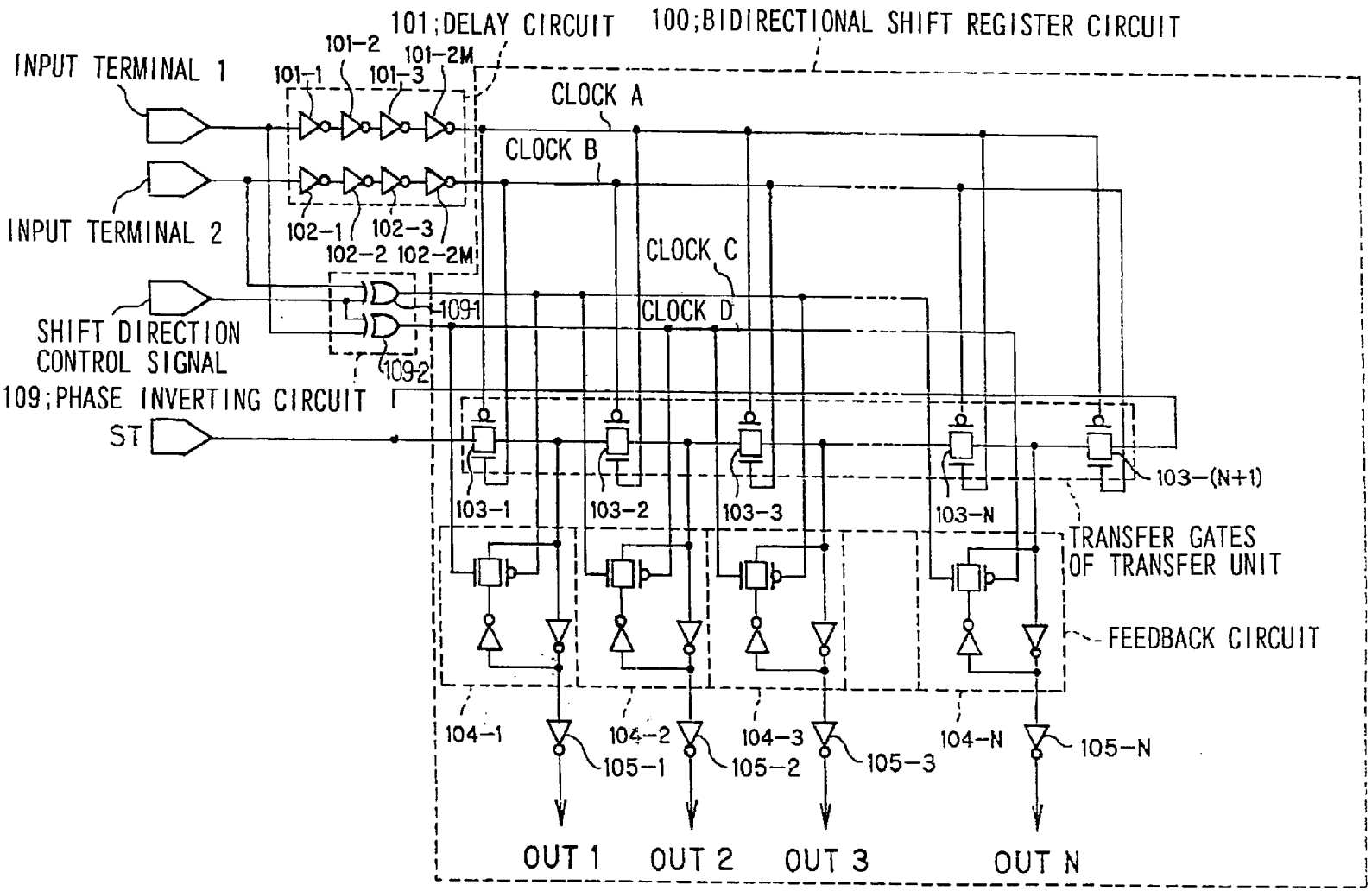
FIG. 4 A diagram showing the configuration of the second embodiment of the present invention.

FIG. 4 is a diagram showing the configuration of a second embodiment of the present invention. The second embodiment of the present invention is substantially identical with the above-mentioned first embodiment shown in FIG. 1 except that the bidirectional shift register circuit and delay circuit are added with a phase inverting circuit 109.

In order to distribute the clock signals 1 and 2 for controlling the scanning circuit to the delay circuit 101 and the phase inverting circuit 109, respectively, one of the input terminals of the delay circuit 101 and one of the input terminals of the phase inverting circuit 109 are in parallel connected to the input terminal 1. The other input terminal of the delay circuit 101 and the other input terminal of the phase inverting circuit 109 are in parallel connected to an input terminal 2. Similarly to the above-mentioned first embodiment, the delay circuit 101 comprises in series connected inverters 101-1 through 101-M and 102-1 through 102-M. The outputs of the delay circuit 101 are connected to the transfer gates 103 of the transfer unit of the bidirectional shift register circuit 100 to output the clocks A and B.

The phase inverting circuit 109 comprises two E×OR gates (exclusive logical sum) 109-1 and 109-2 for conducting inverting/non-inverting of the input clocks depending upon the level of the shift direction control signal as shown in FIG. 4. An output of the input terminal 1 and the shift direction control signal are input to the two input terminals of the E×OR gate (exclusive logical sum) 109-1. Also, an output of the input terminal 2 and the shift direction control signal are input to the two input terminals of the E×OR gate 109-2. The phase inverting circuit 109 may be configured so that the result of logical operation between the shift direction control signal and the signals on the input terminals is equivalent to an E×OR operation and may include a logical circuit depending on the logic of the shift direction control signal. The configuration of the phase inverting circuit 109 is not limited to the E×OR gate.

The output of the phase inverting circuit 109 is connected to the transfer gate 108 of the feedback circuit 104 of the bidirectional shift register circuit 100 to provide clocks C and D.

The delay circuit 104 is configured in such a manner that the clocks A and B which are the outputs from the delay circuit 101 are always delayed relative to the outputs C and D of the phase inverting circuit 109.

Operation of the scanning circuit of the second embodiment of the present invention which is shown in FIG. 4 will be described with reference to timing charts of FIGS. 5 and 6.

The scanning circuit which is shown in FIG. 4 is capable of bidirectionally scanning by presetting the control clocks. Similarly to the operation of the first embodiment, transferring of the start pulse from OUT 1 to OUT N in an ascending order will be defined as rightward shift and transferring of the start pulse from OUT N to OUT 1 in an descending order will be defined as leftward shift. FIGS. 5 and 6 are timing charts explaining the timing relationships of rightward and leftward shifts of the scanning circuit in the second embodiment of the present invention, respectively.

Complementary two phase signals are input to the input terminals 1 and 2 and then distributed to the delay circuit 101 and phase inverting circuit 109. Outputs of the delay circuit 101 are used as clocks A and B for control 1 ng the transfer gates of the transfer unit of the bidirectional shift register circuit. Outputs of the phase inverting circuit 109 are used as clocks C and D for controlling the transfer gates of the feedback circuit 104 of the bidirectional shift register circuit 100. The clocks A and B are always delayed from the clocks C and D by means of the delay circuit 101. The outputs to the clocks C and D can be switched to the same opposite/inverse phase of the signal from the input terminals 1 and 2 depending upon the level of high/low of the shift direction control signal of the phase inverting circuit 109.

Figure 5:
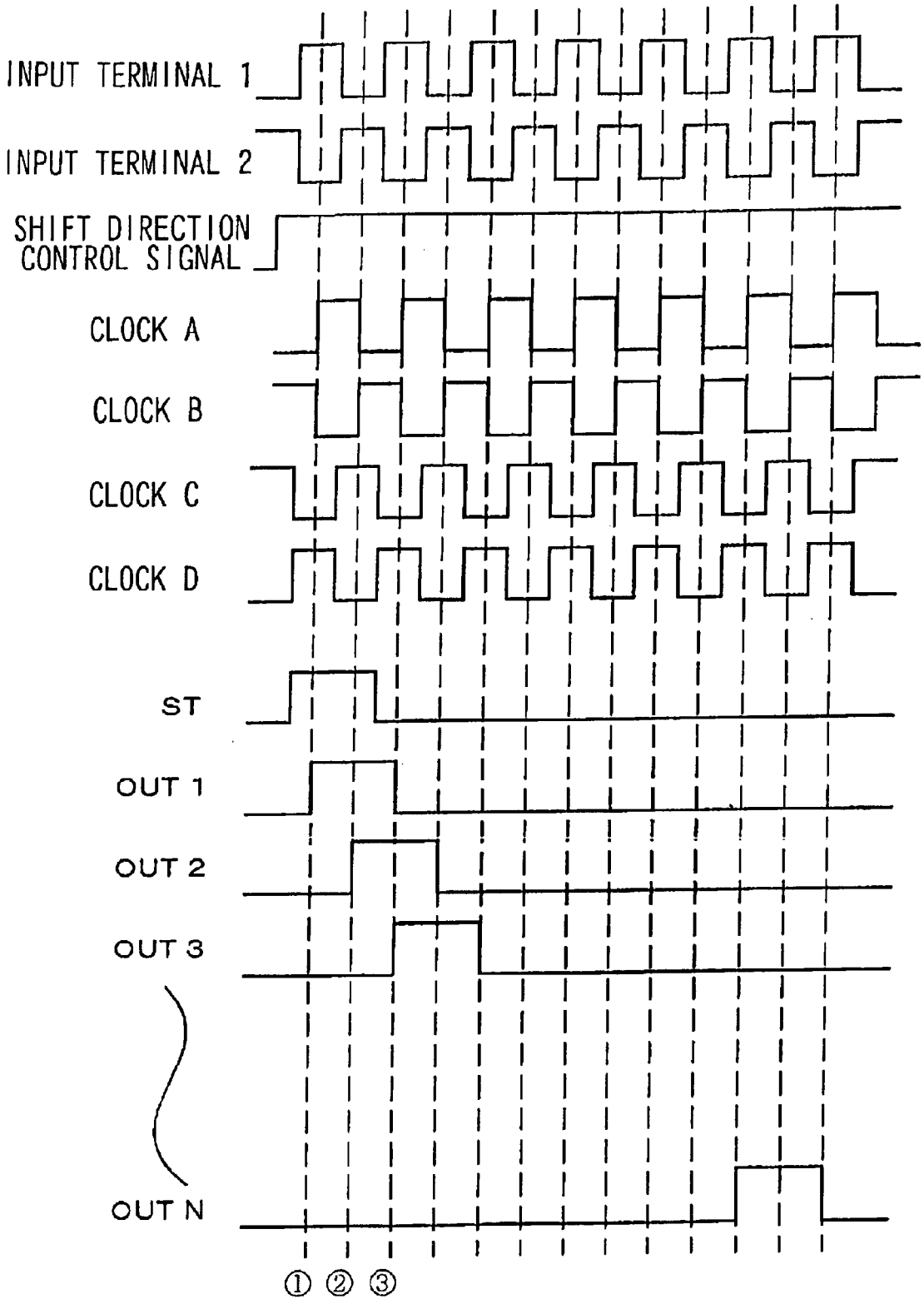
FIG. 5 A timing chart showing rightward shift operation in the second embodiment of the present invention.
Figure 6:
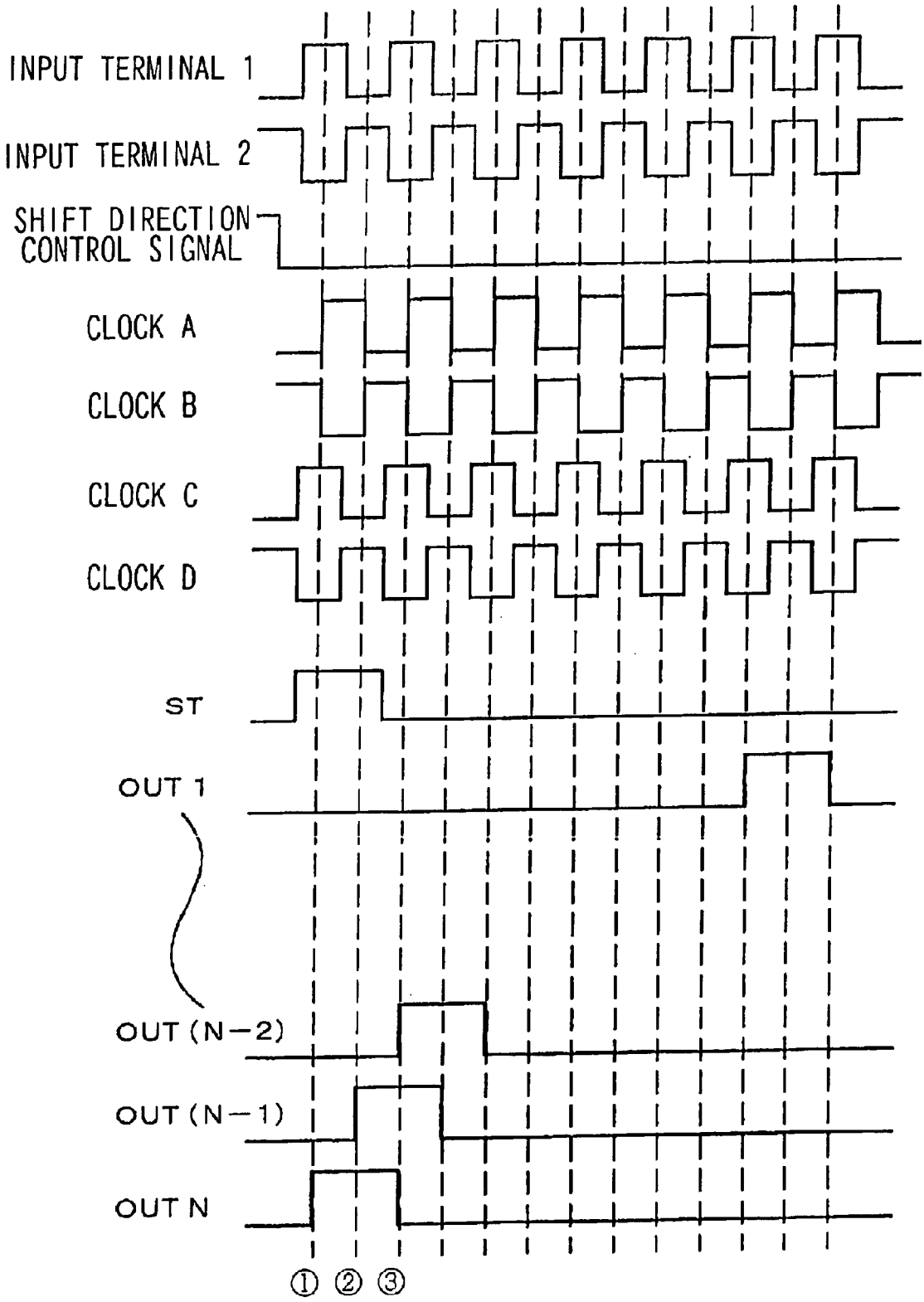
FIG. 6 A timing chart showing leftward shift operation in the second embodiment of the present invention.

When the shift control signal is at the high level as shown in FIG. 5, the clocks A through D have the rightward shift timing relationship similarly to the case shown in FIG. 2. When the shift direction control signal is at the low level as shown in FIG. 6, the clocks have the leftward shift timing relationship similarly to the case in FIG. 3.

The difference between the first and second embodiments of the present invention resides in the configuration for supplying the clocks A through D to the bidirectional shift register. The operation of the bidirectional shift register circuit in response to the clocks A through D which are supplied by the delay circuit 101 and phase inverting circuit 109 from the two phase signals input from the input terminals 1 and 2 of FIG. 4 is substantially identical with the operation of the embodiment 1 which has been described with reference to FIGS. 2 and 3, provided that this embodiment provides a higher phase synchronization between the clocks A and B and clocks C and D.

Since the control clocks for the bidirectional shift register circuit are control led in such a manner that the clocks A and B are always delayed from the clocks C and D by the delay circuit in the scanning circuit of the second embodiment of the present invention, the operation margin for the phase deviation which may occur between the control clocks can be increased. The fact that four-phase control clocks for the bidirectional shift register are generated from the two phase clocks within the scanning circuit enables the external circuit to be simplified. The number of terminals can be reduced by the fact that the number of control lines of the scanning circuit is less than that of the prior art.

The meritorious effects of the present invention are summarized as follows.

The fact that a delay circuit is added within the scanning circuit in accordance with the present invention as mentioned above makes it possible to ensure the operation within the range of the designed delay time even if the above-mentioned phase deviation should occur between control clocks input from the external circuit.

In accordance with the second embodiment of the present invention, the fact that four phase control clocks for the bidirectional shift register are generated from the two phase clocks within the scanning circuit enables the external circuit to be simplified. The number of terminals can be reduced due to the fact that the number of control lines of the scanning circuit is less than that of the prior art.

It should be noted that other objects, features and aspects of the present invention will become apparent in the entire disclosure and that modification may be done without departing the gist and claimed as appended herewith.

Also it should be noted that any combination of the disclosed and/or claimed elements, matters and/or items may fall under the modifications aforementioned.

What is claimed is:

1. A scanning circuit comprising:

a bidirectional shift register having transfer gates of a transfer unit and a feedback circuit, the operation of which is controlled by four phase clocks, wherein said scanning circuit comprises a delay circuit that delays control clocks supplied to said transfer gates of the transfer unit relative to control clocks supplied to said feedback circuit.

2. A scanning circuit comprising:

a transfer unit comprising a plurality of stages of transfer gates which are in series connected to each other, a plurality of feedback circuits which are connected to connecting points between said transfer gates, said feedback circuits eliminating amplitude attenuation of signals transferred through said transfer unit, wherein said scanning circuit comprises a delay circuit that delays control clocks controlling operation timing of the transfer gates of the transfer unit relative to control clocks controlling operation timing of said feedback circuit.

3. A scanning circuit comprising:

a transfer unit comprising a plurality of stages of transfer gates which are in series connected with each other, and a plurality of feedback circuits which are connected to connecting points between said transfer gates, said feedback circuits eliminating amplitude attenuation of signals transferred via said transfer unit, (a) wherein said scanning circuit comprises:

a phase control circuit having an input terminal receiving two-phase clocks and outputting a signal obtained by non-inverting/inverting said received two-phase clocks based upon a value of a control signal, and a delay circuit, (b) wherein two-phase clocks from said delay circuit are delayed relative to the two-phase clocks output from the phase control circuit, and (c) wherein the two-phase clocks which have been delayed by said delay circuit are supplied to the transfer gates of the transfer unit, and the two-phase clocks from said phase control circuit are supplied to said feedback circuits.

4. The scanning circuit as defined in claim 2 wherein each of said feedback circuits comprises:

a first inverter having an input terminal connected to a connection point between transfer gates which form the transfer unit, and a second inverter having an input terminal connected to an output terminal of said first inverter and an output terminal connected to the input terminal of said first inverter via a transfer gate which is turned on or off in response to the clocks supplied to the feedback circuit.

5. The scanning circuit as defined in claim 3 wherein each of said feedback circuits comprises:

a first inverter having an input terminal connected to a connection point between transfer gates which form the transfer unit, and a second inverter having an input terminal connected to an output terminal of said first inverter and an output terminal connected to the input terminal of said first inverter via a transfer gate which is turned on or off in response to the clocks supplied to the feedback circuit.

6. The scanning circuit as defined in claim 2 wherein each of said feedback circuits comprises:

a first inverter having an input terminal connected to a connection point between transfer gates which form the transfer unit, and a clocked inverter having an input terminal connected to an output terminal of said first inverter and an output terminal connected to the input terminal of said first inverter, said clocked inverter being turned on or off in response to the clocks supplied to the feedback circuits.

7. The scanning circuit as defined in claim 3 wherein each of said feedback circuits comprises:

a first inverter having an input terminal connected to a connection point between transfer gates which form the transfer unit, and a clocked inverter having an input terminal connected to an output terminal of said first inverter and an output terminal connected to the input terminal of said first inverter, said clocked inverter being turned on or off in response to the clocks supplied to the feedback circuits.

8. A scanning circuit, wherein said scanning circuit comprises:

(a) a transfer unit having a plurality of stages of transfer gates which are in series connected to each other, said transfer gates delaying and transferring input pulse signals;

(b) a plurality of feedback circuits including two stage inverters, each of said feedback circuits being connected to a connecting point between said transfer gates and have input and output terminals which are connected to each other via a switch; and (c) a delay circuit that delays a phase of a clock controlling timing relationship of turning on or off of the transfer gates of said transfer unit relative to the phase of the clock controlling timing relationship of turning on or off of said feedback circuits.

9. A scanning circuit comprising:

(a) a transfer unit having a plurality of stages of transfer gates which are in series connected to each other to delay and transfer input pulse signals;

(b) a plurality of feedback circuits each including an inverter and a clocked inverter, each of said feedback circuits being connected to a connecting point between said transfer gates and having input and output terminals which are connected to each other for feedback; and (c) a delay circuit that delays a phase of a clock for controlling timing relationship of turning on or off of the transfer gates of said transfer unit relative to a phase of a clock for controlling timing relationship of turning on or off of the clocked inverter of said feedback circuit.

10. The scanning circuit as defined in claim 8, wherein said scanning circuit further comprises a phase control circuit having an input terminal to which two-phase clocks are input to output signals obtained by non-inverting/inverting said input two-phase clocks based upon a value of a control signal for controlling a shift direction, and wherein said delay circuit delays input two-phase clocks relative to said signals of two-phase clocks output from said phase control circuit.

11. The scanning circuit as defined in claim 9, wherein said scanning circuit further comprises a phase control circuit having an input terminal to which two-phase clocks are input to output signals obtained by non-inverting/inverting said input two-phase clocks based upon a value of a control signal for controlling a shift direction, and wherein said delay circuit delays saidinput two-phase clocks relative to said signals of two-phase clocks output from said phase control circuit.

12. The scanning circuit as defined in claim 1, wherein said scanning transfer unit comprises an input terminal which receives an input signal, said input terminal being connected to one end and the other end of said bidirectional shift register.

13. The scanning circuit as defined in claim 2, wherein said scanning transfer unit comprises an input terminal which receives an input signal, said input terminal being connected to one end and the other end of said transfer unit.

14. The scanning circuit as defined in claim 3, wherein said scanning transfer unit comprises an input terminal which receives an input signal, said input terminal being connected to one end and the other end of said transfer unit.

15. The scanning circuit as defined in claim 8, wherein said scanning transfer unit comprises an input terminal which receives an input signal, said input terminal being connected to one end and the other end of said transfer unit.

16. The scanning circuit as defined in claim 9, wherein said scanning transfer unit comprises an input terminal which receives an input signal, said input terminal being connected to one end and the other end of said transfer unit.

* * * * *